US006539563B1

(12) United States Patent
Hsia

(10) Patent No.: US 6,539,563 B1
(45) Date of Patent: Apr. 1, 2003

(54) BASSINET ARRANGEMENT

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 09/978,461

(22) Filed: Oct. 15, 2001

(51) Int. Cl.[7] ..... A47D 7/00; A47D 13/00

(52) U.S. Cl. ..... 5/93.2; 5/93.1; 5/98.1; 248/150; 248/153

(58) Field of Search ..... 5/93.1, 95, 98.1, 5/93.2, 655, 94, 101, 102; 248/150, 153

(56) References Cited

U.S. PATENT DOCUMENTS 5,778,465 A * 7/1998 Myers ..... 5/99.1
5,819,341 A * 10/1998 Simantob et al. ..... 5/93.2
5,867,850 A * 2/1999 Mariol ..... 5/93.2
6,182,308 B1 * 2/2001 Yang ..... 5/93.1
6,192,535 B1 * 2/2001 Warner, Jr. et al. ..... 5/93.2

* cited by examiner

*Primary Examiner*—Alexander Grosz
(74) *Attorney, Agent, or Firm*—Raymond Y. Chan

(57) ABSTRACT

A bassinet arrangement is detachably mounted on a playpen which includes a frame body having a top opening defining a surrounding supporting side edge and a storage chamber communicating with the top opening. The bassinet arrangement includes a fabric boundary having a first compartment, a second compartment adjacent thereto and a surrounding edge holder encirclingly provided on the fabric boundary for detachably mounting on the supporting side edge of the frame body of the playpen. The bassinet arrangement further includes a fastening unit provided on the edge holder and the frame body of the playpen for securely mounting the fabric boundary on the playpen and a bassinet adapted for substantially disposed in the second compartment. Therefore, the parent is able to accommodate his baby in the bassinet that is selectively supported on the playpen at home and carried everywhere.

13 Claims, 6 Drawing Sheets

BASSINET ARRANGEMENT

BACKGROUND OF THE PRESENT INVENTION

1. Field of Invention

The present invention relates to baby accessories, and more particularly to a bassinet arrangement which is adapted for accommodating a child therein while being cost effective.

2. Description of Related Arts

Bassinet and playpen, which become necessities to every family having a young child or baby, are considered as conveniences tools to carry and accommodate the baby respectively.

It is no doubt that the bassinet is lightweight and portable. However, at home, the parents may pull their children to the infant bed rather than in the bassinet. It is because the parents must find a safe surface to support the bassinet. Otherwise, the bassinet has an adverse effect of rocking and shaking. So, the baby may feel uncomfortable and unsafe when the bassinet is shaking. Furthermore, the infant bed has relative larger storage space than the bassinet. Therefore, the bassinet will be stored somewhere in the house, which is a waste of the luxury space. Thus, when the child grows up, the parent may merely keep purchasing all the baby's accessories, such as a playpen and bed having a bigger size, individually that occupy all the luxury space at home.

The playpen is normally used to restrict the movement of the baby or young child who is able to trail or walk when the parents cannot always keep their eyes on their babies. Since the playpen can provide an absolutely safe boundary for the children, the playpen must be constructed rigidly and the depth of the playpen must be deep enough to prevent the children from climbing out of the playpen. However, it is a hassle for the parent to pull and take a small child in the playpen. Therefore, there is a headache for the parents that how to accommodate their child at home safety.

SUMMARY OF THE PRESENT INVENTION

A main object of the present invention is to provide a bassinet arrangement which is adapted for accommodating a child therein while being cost effective.

Another object of the present invention is to provide a bassinet arrangement which substantially increases the supporting area of the playpen to rigidly support the bassinet thereon. Thus, the infant bed can be provided on the supporting area of the playpen. In other words, the bassinet arrangement of the present invention fits for any age of a child from infant up to five years olds.

Another object of the present invention is to provide a bassinet arrangement, which is adapted to incorporate with a playpen without altering the original structural design of the playpen, so as to minimize the manufacturing cost of the playpen incorporating with the bassinet arrangement.

Another object of the present invention is to provide a bassinet arrangement, wherein the attachment between the bassinet and the playpen is easy and fast, that is simply by tightly fastening the edge holder of the fabric pocket on the opening edge of the playpen.

Another object of the present invention is to provide a bassinet arrangement, wherein no expensive or complicate structure is required to employ in the present invention in order to achieve the above mentioned objects. Therefore, the present invention successfully provides an economic and efficient solution for selectively using as a bassinet supporter, an infant bed, and the playpen.

Accordingly, in order to accomplish the above objects, the present invention provides a bassinet arrangement adapted for detachably mounting on a playpen which comprises a frame body having a top opening defined a surrounding supporting side edge and a storage chamber communicating with the top opening.

The bassinet arrangement, comprising:

a fabric boundary having a first compartment and a second compartment adjacent to the first compartment and a surrounding edge holder extended along on the fabric boundary for detachably mounting on the supporting side edge of the frame body of the playpen;

a fastening unit provided on the edge holder and the frame body of the playpen for securely mounting the fabric boundary on the playpen; and a bassinet shaped and sized to be able to substantially dispose in the second compartment.

DETAILED DESCRIPTION OF THE PREFERRED EMBODIMENT

Figure 1:
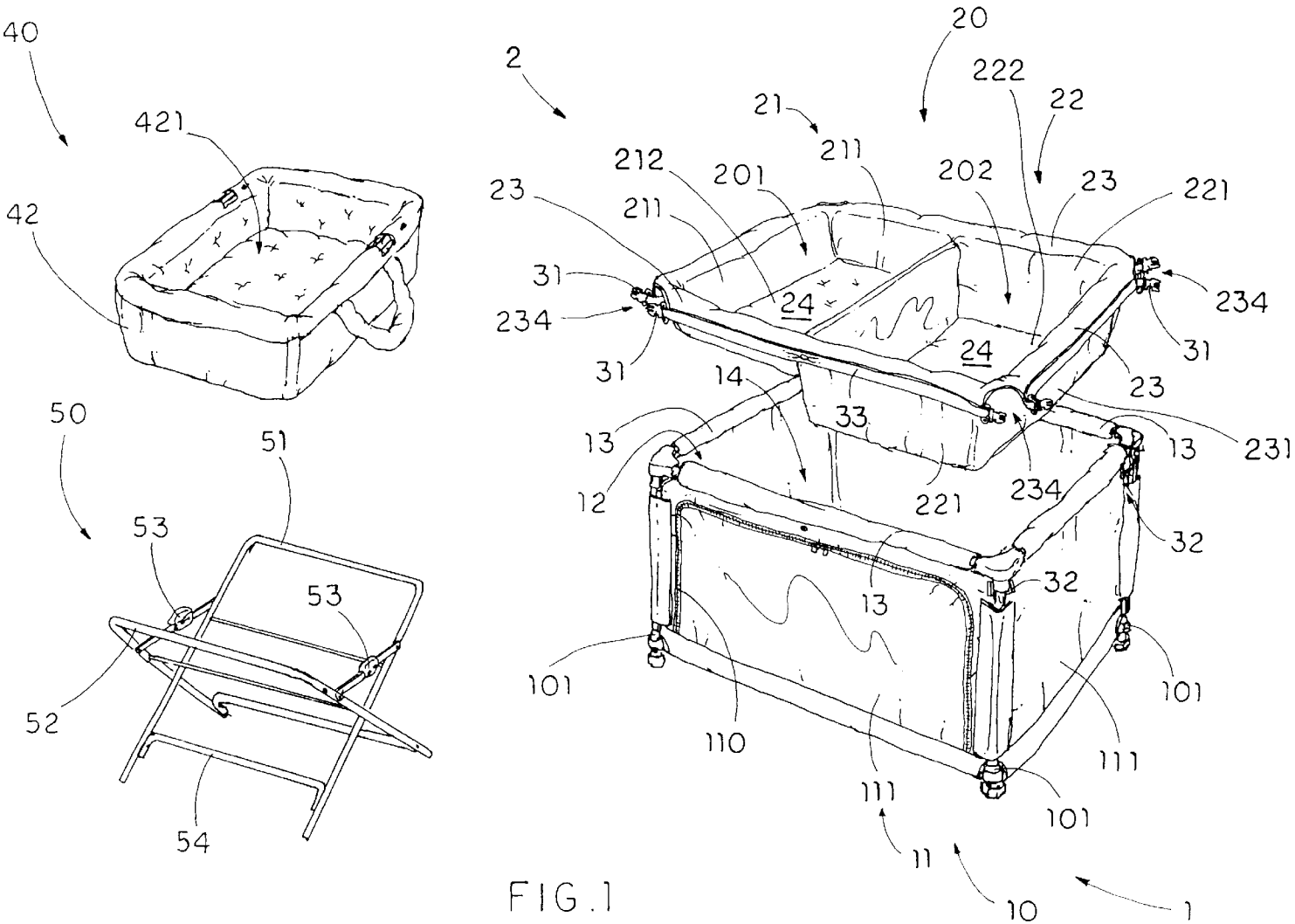
FIG. 1 is a perspective view of a bassinet arrangement incorporated with a playpen according to a preferred embodiment of the present invention.
Figure 2:
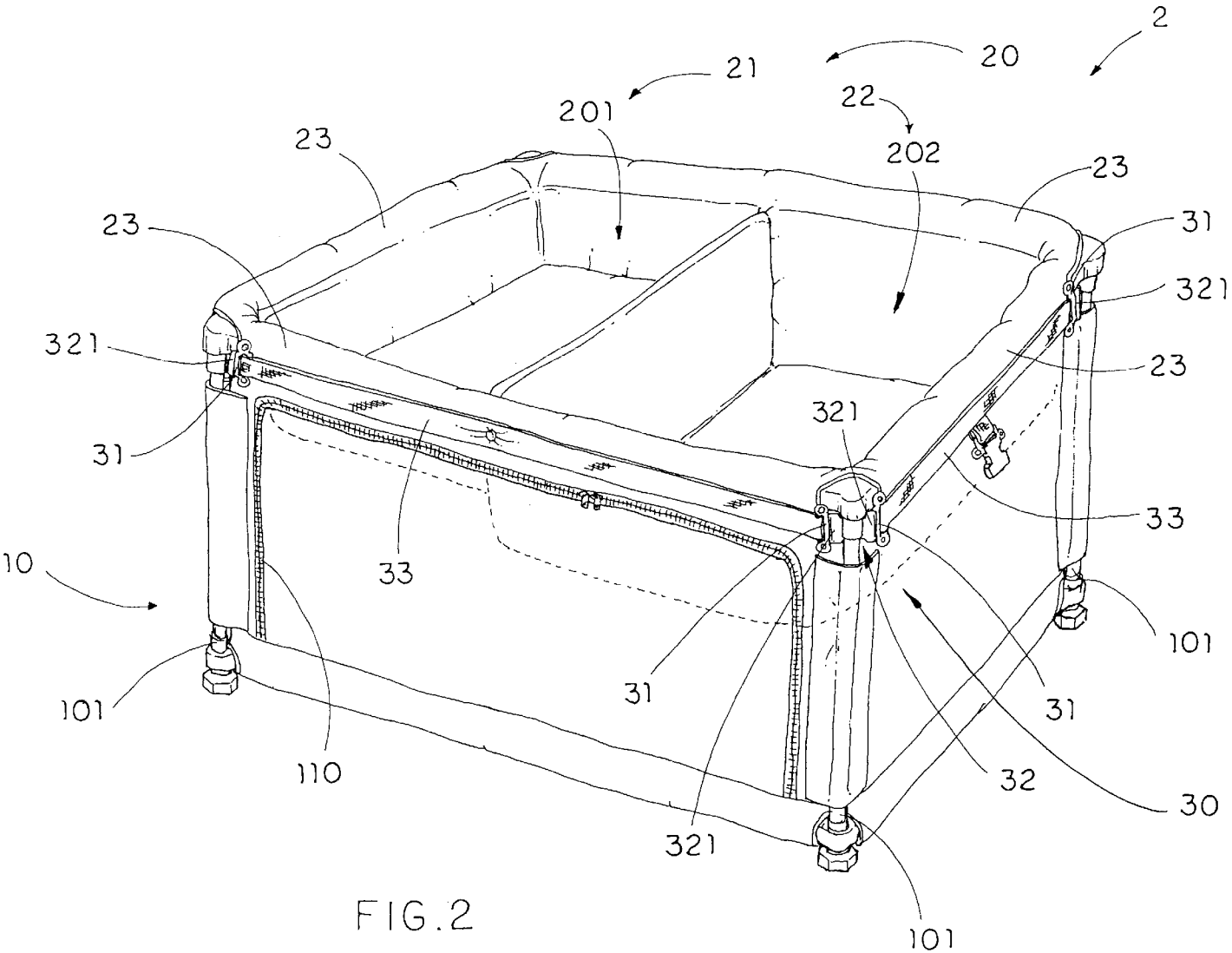
FIG. 2 is a perspective view of a fabric boundary of the bassinet arrangement according to the above preferred embodiment of the present invention.

Referring to FIGS. 1 and 2 of the drawings, a bassinet arrangement 2 incorporated with a playpen 1 according to a preferred embodiment of the present invention is illustrated. The playpen 1 comprises a frame body 10 comprising four supporting posts 101 support a box-shaped fabric made boundary shelter 11 therebetween. The boundary shelter 11 has four surrounding walls 111 and a bottom wall 112 to form a top opening 12 and defined a surrounding supporting side edge 13 and a storage chamber 14 defined between the surrounding walls 111 and communicating with the top opening 12.

The bassinet arrangement 2 comprises a fabric boundary 20 having a first compartment 201 and a second compartment 202 adjacent to the first compartment 201 wherein a depth of the first compartment 201 is smaller than that of the second compartment 202 and a surrounding edge holder 23 extended along on the fabric boundary 20 for detachably mounting on the supporting side edge 13 of the frame body 10 of the playpen 1.

Figure 3:
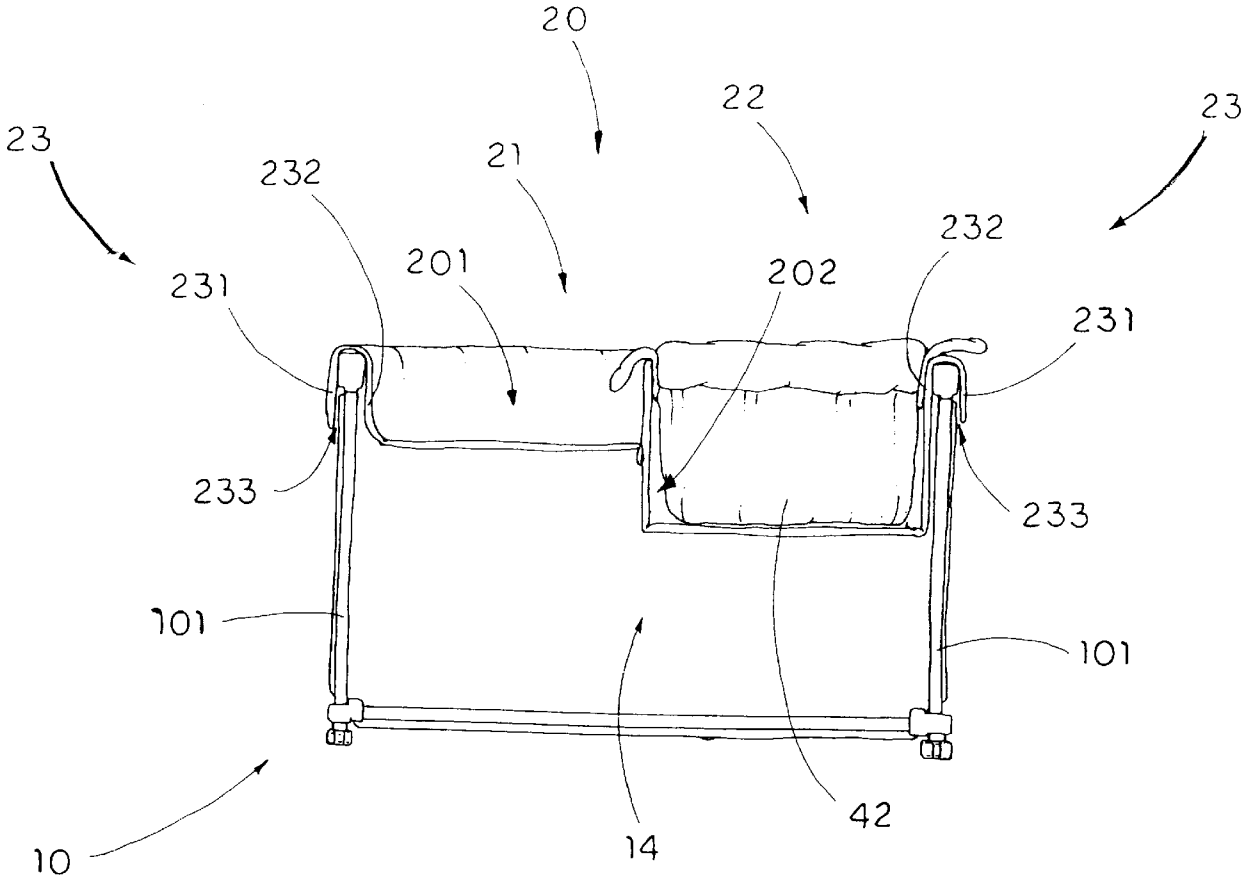
FIG. 3 is a sectional view of the fabric boundary of the bassinet arrangement according to the above preferred embodiment of the present invention.

The bassinet arrangement 2 further comprises a fastening unit 30 provided on the edge holder 23 and the frame body 10 of the playpen 1 for securely mounting the fabric boundary 20 on the playpen 1, and a bassinet 40 shaped and sized to be able to substantially dispose in the second compartment 202. As best seen in FIGS. 1 and 3, bassinet 40 is substantially shaped and sized to be fittingly and removably positioned in the second compartment 202.

According to the preferred embodiment, the fabric boundary 20 comprises a first pocket 21 having four first surrounding sheets 211 and a first bottom sheet 212 to form the first compartment 201 having a box shape and a second pocket 22 having four second surrounding sheets 221 and a second bottom sheet 222 to form the second compartment 202 having a box shape, wherein one of the first surrounding sheets 211 is overlapped with one of the second surrounding sheets 221 such that the first pocket 21 is positioned adjacent to the second pocket 22. The fabric boundary 20 further comprises two cushion layers 24 disposed in the first and second compartments 201, 202 respectively for providing a soft and comfortable support for the baby.

Besides, each of the first surrounding sheets 221 having a vertical length shorter than a vertical length of each of the second surrounding sheets 221 such that the depth of the first compartment 201 is smaller than that of the second compartment 202.

The fabric made edge holder 23 having a rectangular shape is firmly attached to a top portion of the fabric boundary 20, which is encircling with the first and second pockets 21, 22, wherein the edge holder 23, having a U-shaped cross section, has an outer wall 231 and an inner wall 232 to define a positioning groove 233 that opens downward for receiving the supporting side edge 13 of the frame body 10. Preferably, the edge holder 23 should be constructed with a cushion pad that provides a softness and comfort and prevents any unwanted injury to the baby.

In order to form the edge holder 23, the outer wall 231 is formed by folding the top edge portion of the fabric boundary 20 to an outer surface thereof overlappedly so as to define the positioning groove 233 between the inner wall 232 and the outer wall 231.

In order to fittedly mount the edge holder 23 on the supporting side edge 13 of the frame body 10, the edge holder 23 further has four U-shaped corner openings 234 provided at four corners of the outer wall 231 of the edge holder 23 for holding around the four supporting posts 101 of the playpen 1.

The fastening unit 30 comprises a plurality of first fastener units 31 provided on the outer wall 231 at the corner openings 234 respectively and a plurality of second fastener units 32 provided at four upper corners of the frame body 10 for detachably fastening with the first fastener units 31 respectively so as to securely mount the fabric boundary 20 on the frame body 10.

Accordingly, each of the first fastener units 31 comprises two buckle plugs positioned at two ends of the respective corner opening 234 and each of the second fastener units 32 comprises a buckle socket having two opposed socket inlets 321 to detachably fasten with the two first fastener units 31 positioned at the respective corner opening 234 respectively as shown in FIG. 3.

The fastening unit 30 further comprises a plurality of positioning straps 33 transversely mounted on the outer wall 231 and extended from one corner opening 234 to another corner opening 234 wherein each of the positioning straps 33 has two free ends. Moreover, the positioning straps 33 can enhance the tight mounting engagement between the edge holder 23 and the supporting side edge 13 of the frame body 10 so as to secure the fabric boundary 20 on the playpen 1.

Figure 4:
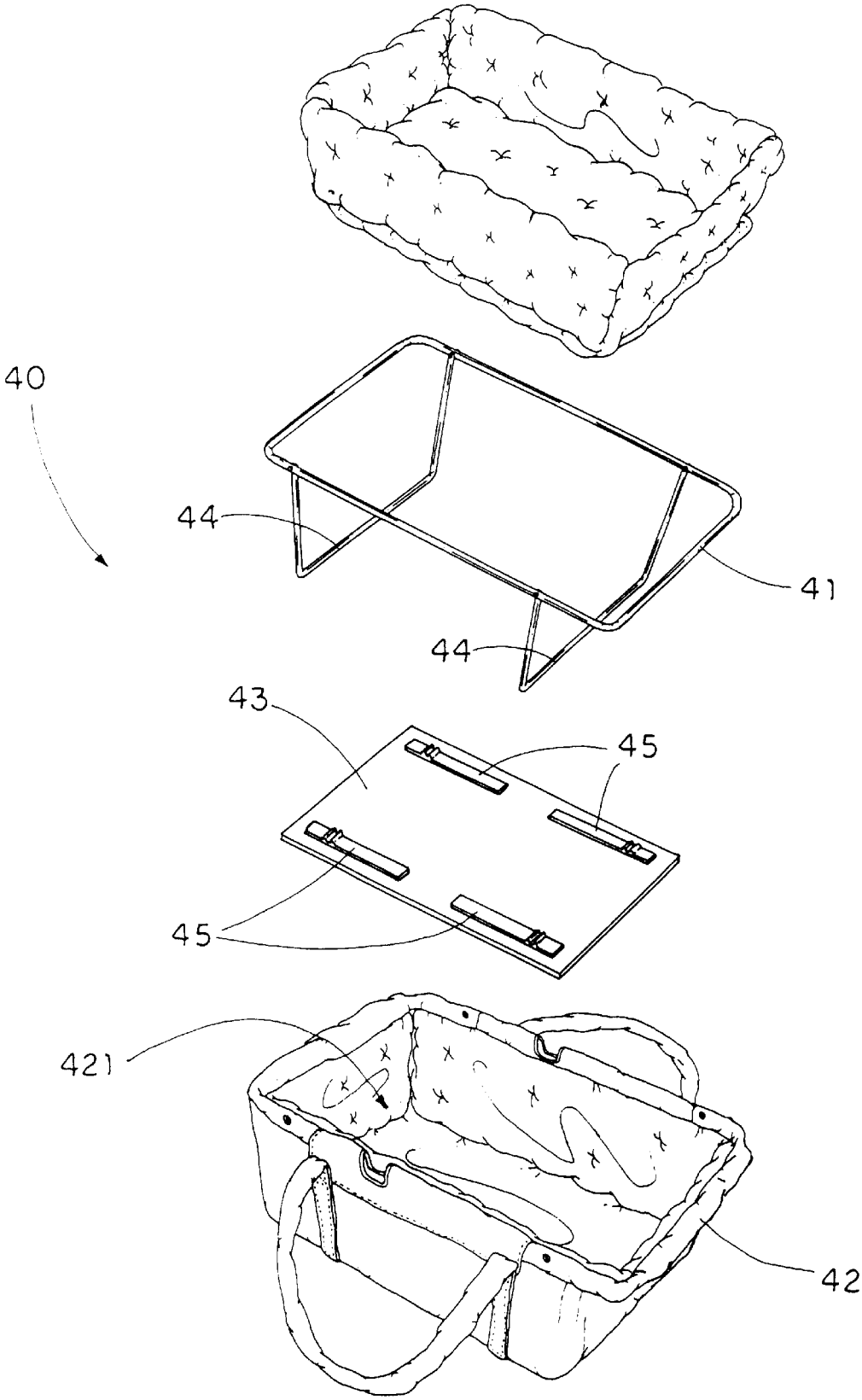
FIG. 4 is an exploded perspective view of the bassinet arrangement according to the above preferred embodiment of the present invention.

As shown in FIG. 4, in order to rigidly support the user in the bassinet 40, the bassinet 40 comprises a boundary frame 41, a fabric bassinet shelter 42 supported thereon to define a supporting cavity 421, a supporting board 43 disposed in the supporting cavity 421, a pair of U-shaped folding arms 44 each having two upper ends pivotally connected to the boundary frame 41, and at least a pair of locking members 45 mounted on the supporting board 43 for detachably locking with the folding arms 44 respectively wherein each of the folding arms 44 has a height equals to a depth of the supporting cavity 421, in such a manner that when the folding arms 44 are locked at the supporting board 43, a downward force of the user's weight can be evenly distributed to the boundary frame 41 through the folding arms 43, so as to substantially support the user in the bassinet 40.

Figure 5:
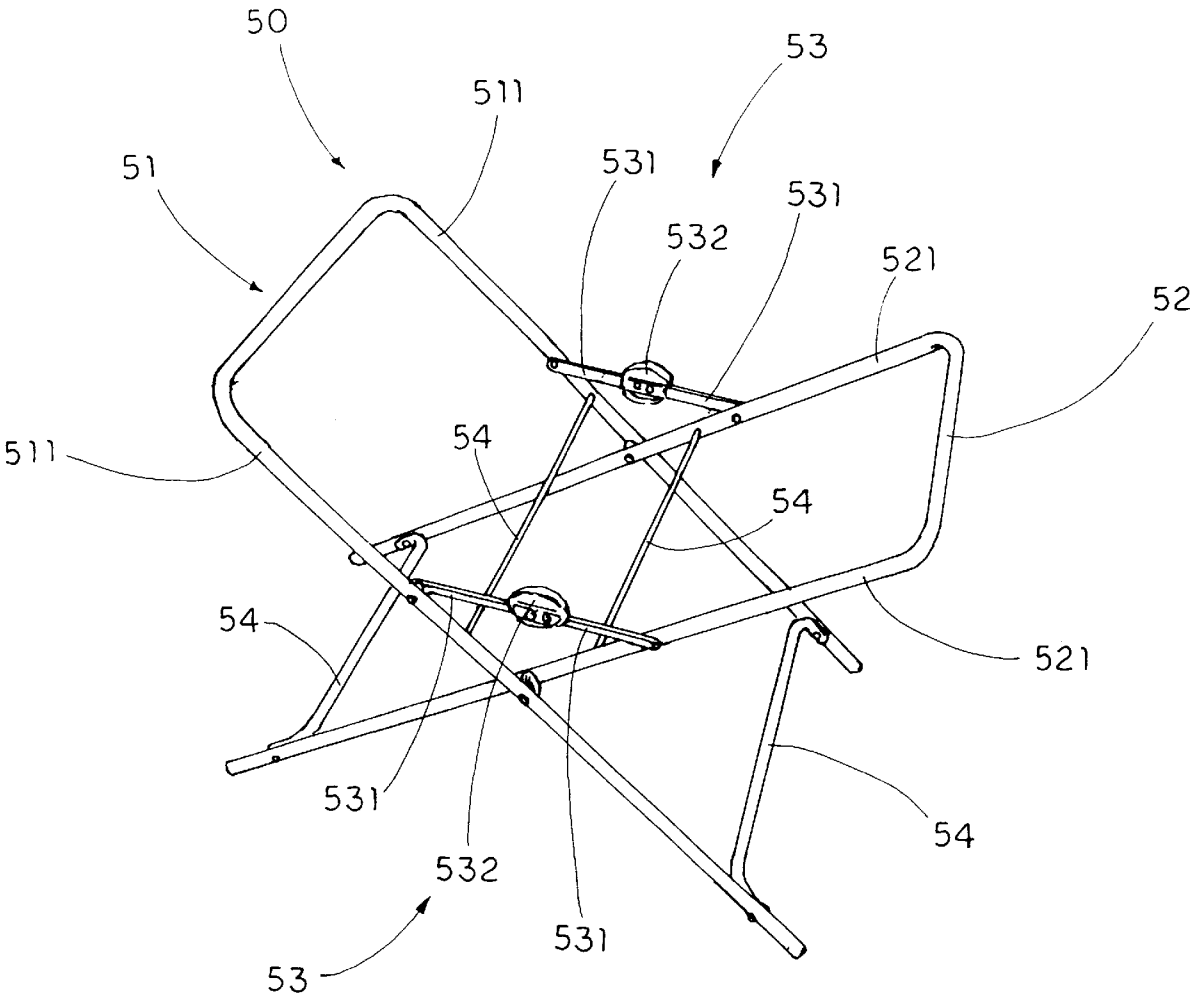
FIG. 5 is a perspective view of a foldable bassinet stand of the bassinet arrangement according to the above preferred embodiment of the present invention.
Figure 6:
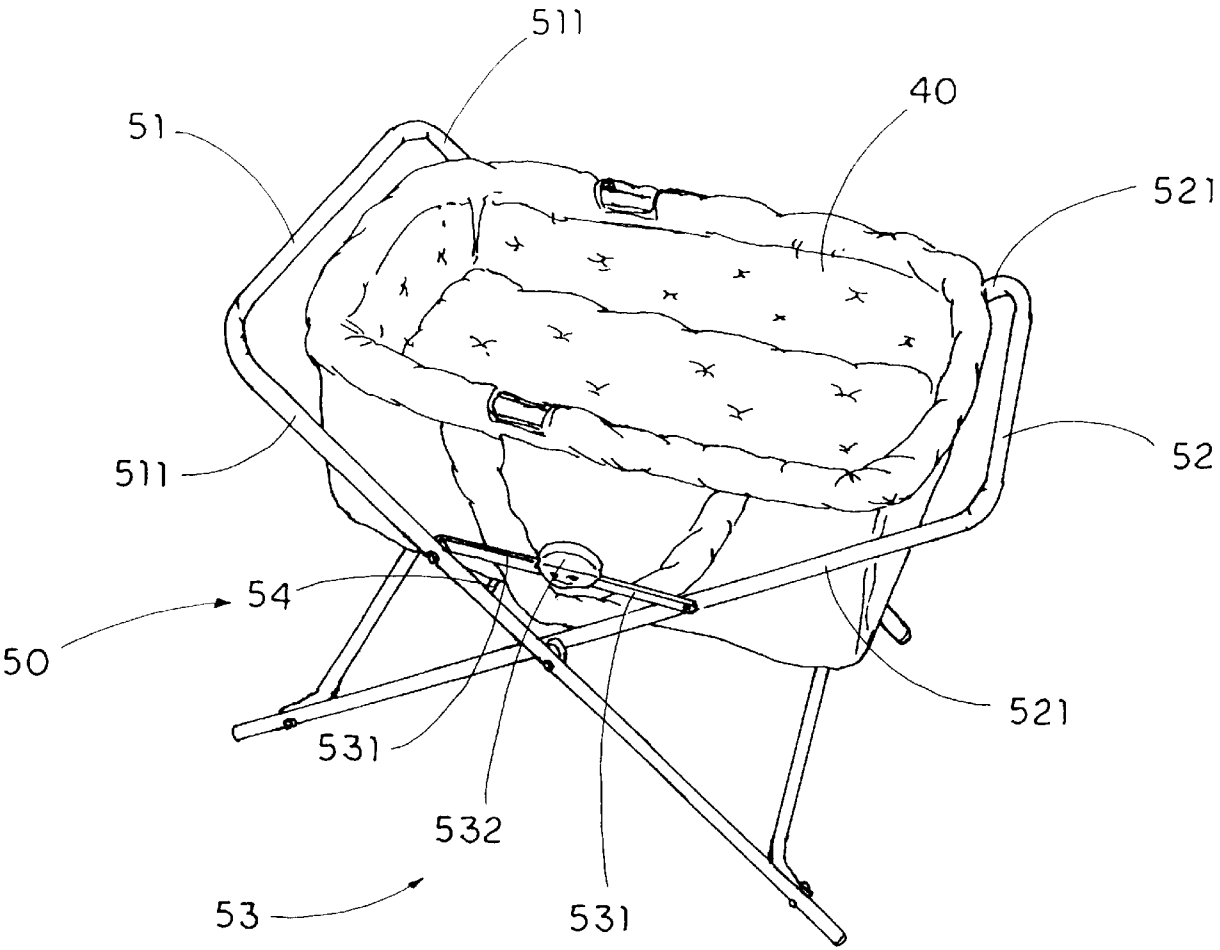
FIG. 6 is a perspective view of the bassinet mounted on the foldable bassinet stand according to the above preferred embodiment of the present invention.

As shown in FIG. 5, the bassinet arrangement 2 further comprises a foldable bassinet stand 50 for rigidly supporting the bassinet 40 individually wherein the bassinet stand 50 comprises a U-shaped first stand frame 51 having a pair of first frame legs 511, a U-shaped second stand frame 52 having a pair of second frame legs 521 pivotally connected to the first frame legs 511 of the first stand frame 51 respectively, and a pair of folding joints 53 each having two pivot arms 531 pivotally connected to the first and second frame legs 511, 521 respectively for retaining a rotational movement between the first and second stand frames 51, 52. Therefore, the bassinet 40 is adapted for rigidly supporting on the bassinet stand 50 between the first and second stand frame 51, 52, as shown in FIG. 6.

Accordingly, each of the folding joints 53 comprises a joint member 532 wherein the two pivot arms 531 has one end pivotally connected to the joint member 532 and another end pivotally connected to an upper portion of one of the first and second frame legs 511, 521. The bassinet stand 50 further comprises at least two supporting pillars 54 rigidly mounted on the first and second stand frames 51, 52 wherein one of the supporting pillars 54 is mounted between the two first frame legs 511 of the first stand frame 51 and another supporting pillar 54 is mounted between the two second frame legs 521 of the second frame stand 52, so as to form a rigid structure,of the bassinet stand 50.

Furthermore, a U-shaped side opening 110 is provided on one of the surrounding walls 111 of the boundary shelter 11 such that the playpen 1 can be formed as a storage for storing the baby's accessories such as diaper when the fabric boundary 20 is mounted on the playpen 1. In other words, the present invention occupies minimized space for storing the baby's accessories at home.

It is worth to mention that the infant is able to accommodate on the bassinet 40 that can be supported by either the fabric boundary 20 or the bassinet stand 50 such that the parent can carry the infant by the basinet 40 everywhere at home. Thus, it is convenient for the parent that the infant can lay in the first compartment 201 for changing diaper when the bassinet 40 is supported in the second compartment 201. When the infant grows up, the second compartment 202 can be used as a bed for the baby sleeping therein. Moreover, the fabric boundary 20 can be detached from the playpen 1 such that the parent can pull his or her young child in the playpen 1 to restrict the movement of the young child. In other words, the parent is able to keep using the bassinet arrangement 2 of the present invention for his or her baby from infant to a young child up to five years olds.

What is claimed is:

1. A bassinet arrangement for a playpen which comprises a frame body having a top opening defined by a surrounding supporting side edge and a storage chamber communicating with the top opening, wherein said bassinet arrangement comprises:

a fabric boundary having a first compartment, a second compartment adjacent to said first compartment, and a surrounding edge holder extended along said fabric boundary for detachably mounting on said supporting side edge of said frame body of said playpen;

a fastening unit provided on said edge holder and said frame body of said playpen for securely mounting said fabric boundary on said playpen; and a bassinet which is substantially shaped and sized to be fittingly and removably positioned in said second compartment.

2. The bassinet arrangement, as recited in claim 1, wherein said edge holder is firmly attached along a top portion of said fabric boundary, wherein said edge holder, having a U-shaped cross section, has an outer wall and an inner wall to form a positioning groove that opens downward for receiving said supporting side edge of said frame body.

3. The bassinet arrangement, as recited in claim 2, wherein said edge holder further has four U-shaped corner openings provided at four corners of said outer wall of said edge holder for holding around four supporting posts of the playpen.

4. The bassinet arrangement, as recited in claim 3, wherein said fastening unit comprises a plurality of first fastener units provided on said outer wall at said corner openings respectively and a plurality of second fastener unit provided at four upper corners of said frame body for detachably fastening with said first fastener unit respectively so as to securely mount said fabric boundary on said frame body.

5. The bassinet arrangement, as recited in claim 4, wherein each of said first fastener units comprises two buckle plugs positioned at two ends of said respective corner opening and each of said second fastener units comprises a buckle socket having two opposed socket inlets to detachably fasten with said two buckle plugs positioned at said respective corner opening respectively.

6. The bassinet arrangement, as recited in claim 4, wherein said fabric boundary comprises a first pocket having four first surrounding sheets and a first bottom sheet to form said first compartment having a box shape, and a second pocket having four second surrounding sheets and a second bottom sheet to form said second compartment having a box shape, wherein one of said first surrounding sheets is overlapped with one of said second surrounding sheets such that said first pocket is positioned adjacent to said second pocket.

7. The bassinet arrangement, as recited in claim 6, wherein each of said first surrounding sheets having a vertical length shorter than a vertical length of each of said second surrounding sheets such that a depth of said first compartment is smaller than that of said second compartment.

8. The bassinet arrangement, as recited in claim 4, wherein said bassinet comprises a boundary frame, a fabric bassinet shelter supported thereon to define a supporting cavity, a supporting board disposed in said supporting cavity, a pair of U-shaped folding arms each having two upper ends pivotally connected to said boundary frame, and at least a pair of locking members mounted on said supporting board for detachably locking with said folding arms respectively wherein each of said folding arms has a height equals to a depth of said supporting cavity.

9. The bassinet arrangement, as recited in claim 4, further comprising a foldable bassinet stand for rigidly supporting said bassinet individually wherein said bassinet stand comprises a U-shaped first stand frame having a pair of first frame legs, a U-shaped second stand frame having a pair of second frame legs pivotally connected to said first frame legs of said first stand frame respectively, and a pair of folding joints each having two pivot arms pivotally connected to said first and second frame legs respectively for retaining a rotational movement between said first and second stand frames, so as to rigidly support said bassinet between said first and second stand frames of said bassinet stand.

10. The bassinet arrangement, as recited in claim 2, wherein said bassinet comprises a boundary frame, a fabric bassinet shelter supported thereon to define a supporting cavity, a supporting board disposed in said supporting cavity, a pair of U-shaped folding arms each having two upper ends pivotally connected to said boundary frame, and at least a pair of locking members mounted on said supporting board for detachably locking with said folding arms respectively wherein each of said folding arms has a height equals to a death of said supporting cavity.

11. The bassinet arrangement, as recited in claim 1, wherein said fabric boundary comprises a first pocket having four first surrounding sheets and a first bottom sheet to form said first compartment having a box shape, and a second pocket having four second surrounding sheets and a second bottom sheet to form said second compartment having a box shape, wherein one of said first surrounding sheets is overlapped with one of said second surrounding sheets such that said first pocket is positioned adjacent to said second pocket.

12. The bassinet arrangement, as recited in claim 11, wherein each of said first surrounding sheets having a vertical length shorter than a vertical length of each of said second surrounding sheets such that a depth of said first compartment is smaller than that of said second compartment.

13. The bassinet arrangement, as recited in claim 1, further comprising a foldable bassinet stand for rigidly supporting said bassinet individually wherein said bassinet stand comprises a U-shaped first stand frame having a pair of first frame legs, a U-shaped second stand frame having a pair of second frame legs pivotally connected to said first frame legs of said first stand frame respectively, and a pair of folding joints each having two pivot arms pivotally connected to said first and second frame legs respectively for retaining a rotational movement between said first and second stand frames, so as to rigidly support said bassinet between said first and second stand frames of said bassinet stand.

* * * * *